US005655198A

United States Patent [19]

Ziegelmuller et al.

[11] Patent Number: 5,655,198

[45] Date of Patent: Aug. 5, 1997

[54] CLEANING MECHANISM FOR THE TONING ROLLER OF AN ELECTROSTATOGRAPHIC REPRODUCTION APPARATUS DEVELOPMENT STATION

[75] Inventors: Francisco L. Ziegelmuller, Penfield; Wunan Chang; Timothy G. Armstrong, both of Rochester, all of N.Y.

[73] Assignee: Eastman Kodak Company, Rochester, N.Y.

[21] Appl. No.: 659,465

[22] Filed: Jun. 6, 1996

[51] Int. Cl.[6] ..... G03G 15/06

[52] U.S. Cl. ..... 399/283

[58] Field of Search ..... 399/273, 283, 399/264; 15/256.5, 256.52

[56] References Cited

U.S. PATENT DOCUMENTS 4,632,535 12/1986 Nagata ..... 399/283

5,495,321 2/1996 Sunaga et al. ..... 399/273

*Primary Examiner*—Shuk Lee

*Attorney, Agent, or Firm*—Lawrence P. Kessler

[57] ABSTRACT

A mechanism for cleaning the toning roller of a development station for a reproduction apparatus, the toning roller serving to apply marking particles to a latent image to develop such image. The cleaning mechanism comprises including an elongated polyurethane blade having a lead edge. The elongated polyurethane blade is mounted such that the lead edge contacts such toning roller at an angle to a plane tangent to such toning roller, the angle when measured between the plane and the blade adjacent to the cleaned side of the toning roller being in the range of approximately 10°–30°.

10 Claims, 2 Drawing Sheets

CLEANING MECHANISM FOR THE TONING ROLLER OF AN ELECTROSTATOGRAPHIC REPRODUCTION APPARATUS DEVELOPMENT STATION

BACKGROUND OF THE INVENTION

The present invention relates in general to development stations for reproduction apparatus, and more particularly to a cleaning mechanism including a polyurethane blade cleaner for the toning roller of a development station of an electrostatographic reproduction apparatus.

In reproduction apparatus, such as electrostatographic copiers or printers for example, it is general practice to apply a uniform electrostatic charge to a dielectric member and modify such charge to form a latent charge pattern corresponding in image-wise fashion to information to be reproduced. The latent image charge pattern is then developed by applying pigmented marking particles to the dielectric member. The particles, which are charged to a polarity opposite to that of the latent image charge pattern on the dielectric member or to a substantially different charge level, adhere to the pattern to form a developed image on the dielectric member. The developed image is then fixed to the dielectric member, or transferred to a final receiver member and fixed thereto by heat and/or pressure for example.

One type of development station commonly utilized in electrostatographic reproduction apparatus is the magnetic brush development station. The magnetic brush development station includes a housing providing a reservoir for a supply of developer material. The developer material may be, for example, two-component material comprising magnetic carrier particles and relatively smaller pigmented marking particles. A mechanism, such as a paddle wheel, auger or ribbon blender, is located in the reservoir and serves to stir the carrier particles and marking particles to triboelectrically charge the particles so that the marking particles adhere to the surface of the carrier particles. A transport mechanism brings the developer material into the field of a plurality of magnets within a rotating sleeve (commonly referred to as the toning roller). The rotating sleeve and magnetic fields cause the marking particles to be brought into the vicinity of the latent image charge patterns on the dielectric member to be applied to the latent image charge patterns in order to develop such patterns.

Under certain conditions a fine coating of marking particles (commonly referred to as scum) tends to build up on the toning roller of the magnetic brush development station. Such scum leads to unacceptable degradation of image quality through incomplete development of the latent image charge pattern on the dielectric member. In order to prevent rapid build up of marking particle scum, active cleaner hardware is provided in association with the development station toning roller. See for example U.S. Pat. No. 4,999,675 (issued Mar. 12, 1991, in the names of Speer et al), and U.S. Pat. No. 5,143,017 (issued Sep. 1, 1992, in the names of Haneda et al). Active cleaner hardware, such as that shown in the above mentioned patents, typically includes a skive blade urged into contact with the toning roller of the development station. Known skive blades have been found to be subject to high wear. Such high wear causes heat to be generated of sufficient magnitude to produce undesirable marking particle flakes or agglomerates. Flakes and agglomerates add to image quality degradation by causing objectionable artifacts in the developed images. Also, the skive pressure on the toning roller can result in excessive torque on the drive for the toning roller. This, in turn, leads to a decrease in part life (reliability) and an increase in service costs.

SUMMARY OF THE INVENTION

In view of the foregoing discussion, this invention is directed to a cleaning mechanism for the rotating sleeve (toning roller) of the development station, of an electrostatographic reproduction apparatus, which applies marking particles to a latent image charge pattern to develop such image. Such cleaning mechanism exhibits high cleaning efficiency and high reliability. The cleaning mechanism includes an elongated polyurethane blade having a lead edge. The elongated polyurethane blade is mounted such that the lead edge contacts such toning roller at an angle to a plane tangent to such toning roller, the angle when measured between the plane and the blade adjacent to the cleaned side of the toning roller being in the range of approximately 10°–30°.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
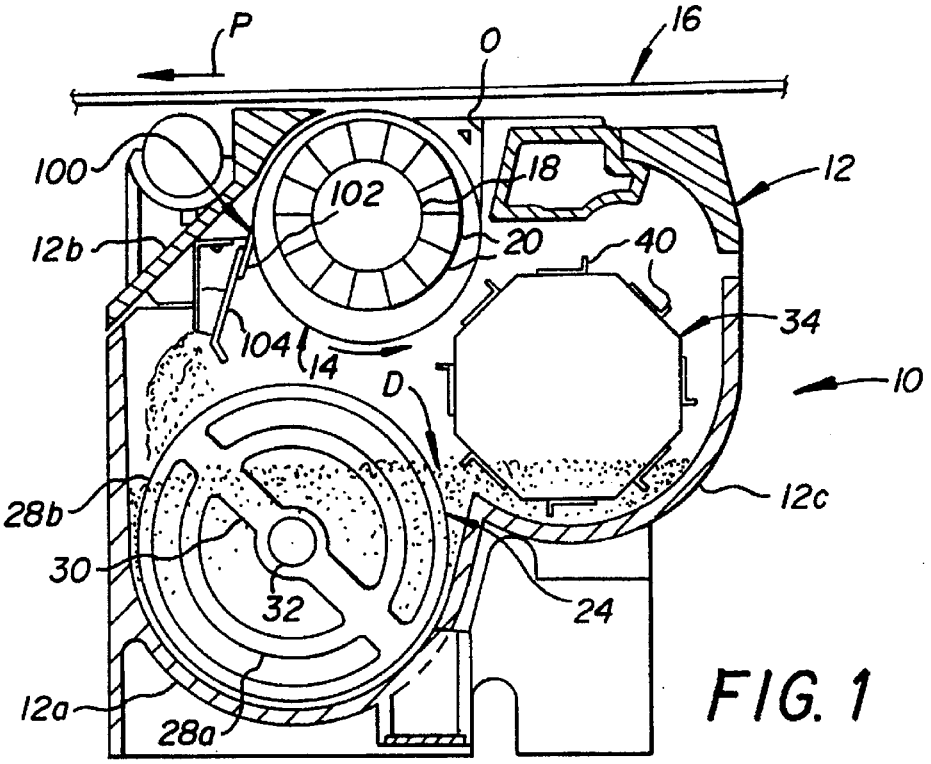
FIG. 1 is side elevational view, in cross-section, of a reproduction apparatus development station having a toning roller cleaning mechanism, according to this invention, with portions removed or broken away to facilitate viewing.

Referring now to the accompanying drawings, FIG. 1 shows, in cross-section, a typical magnetic brush development station 10 for a reproduction apparatus (not shown). The development station 10 incorporates a cleaning mechanism, designated generally by the numeral 100, according to this invention. The magnetic brush development station 10, as shown, is of the type fully described for example in U.S. Pat. No. 4,878,089 (issued Oct. 31, 1989, in the name of Gustlits et al), and is set forth hereinbelow only to the extent necessary to enable one to have a full understanding of the cleaning mechanism of this invention. Of course, other arrangements for reproduction apparatus development stations are suitable for use with this invention.

The magnetic brush development station 10 includes a housing 12 having intercommunicating portions 12*a*–12*c* including a lower portion 12*a* which serves as a reservoir for developer material D. The developer material is for example, a two-component material having magnetic carrier particles intermixed with relatively smaller pigmented marking particles. The upper portion 12*b* of the housing 12 contains a toning roller 14 for applying the marking particles to charge patterns formed on a dielectric member 16 moving along a path P in juxtaposition to an opening O in the upper housing portion 12*b*.

The toning roller 14 of the magnetic brush development station 10 includes a core 18 having a plurality of magnets 20 spaced around the peripheral surface of the core. A non magnetic substantially cylindrical shell 22 surrounds the core 18 and has its longitudinal axis offset from the longitudinal axis of the core. Such offset has the effect of decreasing the field strength of the magnets 20 over the area of the shell 22 spaced farther form the magnets so that the developer material has less propensity to adhere to the shell in that area and returns to the reservoir. As is well known in the art, the core and/or shell can be fixed or rotatable as long as the particular arrangement causes the developer material to move in the fields of the magnets 20 into contact with the dielectric member 16. In the particular toning roller 14 illustrated in FIG. 1, the core 18 (and the magnets 20) rotates clockwise, while the shell 22 rotates counterclockwise. A latent image charge pattern on the dielectric member 16 attracts marking particles from the developer material into adhering relationship with the charge pattern to develop such pattern. The developed pattern can then be subsequently transferred to a final receiver sheet and fixed thereto by heat and/or pressure, or may be fixed directly on the dielectric member, to form a desired reproduction.

Developer material D within the reservoir formed by the housing portion 12*a* is stirred by a mixer 24. The mixer 24 is for example a ribbon blender. The ribbon blender includes an inner helical ribbon 28*a* and an outer helical ribbon 28*b* connected by means of rods 30 to a shaft 32. The shaft 32 is supported in the housing 12 for rotation about longitudinal axis of such shaft. The pitch of the respective ribbons 28*a*, 28*b* are of opposite hand so that, as the shaft 32 rotates the ribbons, developer material is moved in opposite directions along the length of the blender, and the material is agitated to provide a triboelectric charge which causes the marking particles to adhere to the carrier particles. Of course, other types of mixers, such as paddle wheels or augers for example, are suitable for use with this invention.

The mixer 24 also moves developer material radially with respect to the mixer so that the material is moved into the portion of the housing 12 designated by the numeral 12*c*. A transporting mechanism 34 is located within the housing portion 12*c*. The mechanism 34 serves to transport developer material into the field of the magnets 20 of the toning roller 14 via a plurality of pickup members 40. The pickup members 40 are in the general shape of buckets which are moved through the developer material where they pickup developer material. At that point in time when the members 40 respectively pass the top dead center position for the mechanism 34, the developer material is urged by gravitational forces to fall from the members 40. Since the falling developer material is in the magnetic field of the magnets 20 of the toning roller 14, the material is readily attracted to the shell 22 of the toning roller. The developer material is then moved by the toning roller 14 into applying relation with the charge pattern bearing member 16 in the well known manner to develop a latent image charge pattern on such member.

Figure 4:
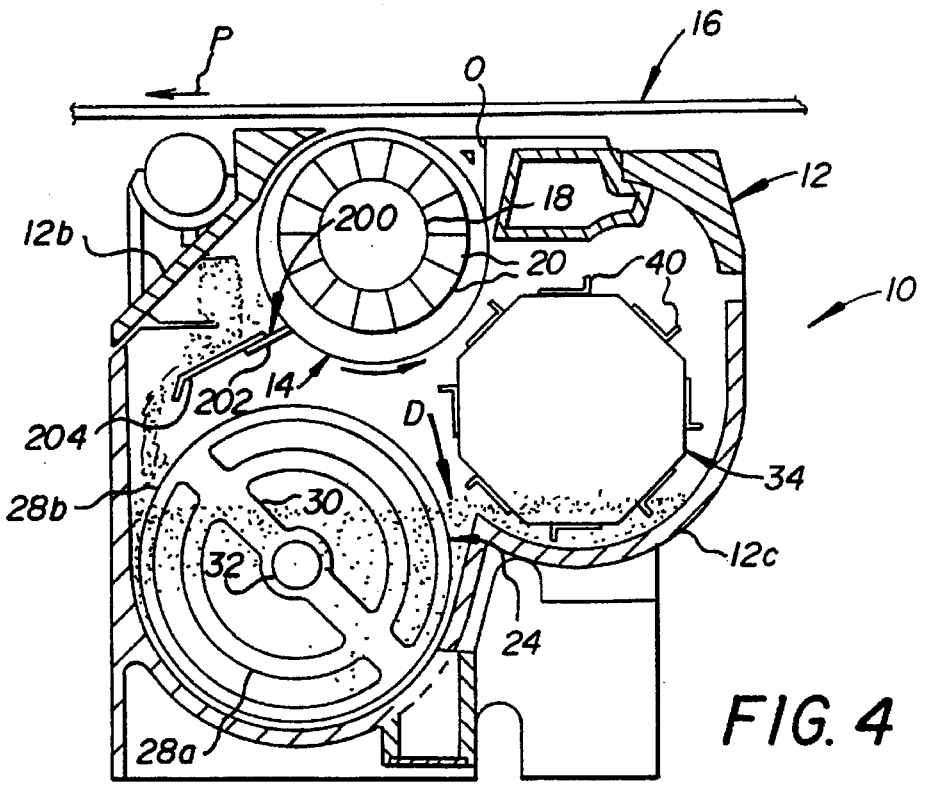
FIG. 4 is side elevational view, in cross-section, of a reproduction apparatus development station having an alternate toning roller cleaning mechanism, according to this invention, with portions removed or broken away to facilitate viewing.
Figure 5:
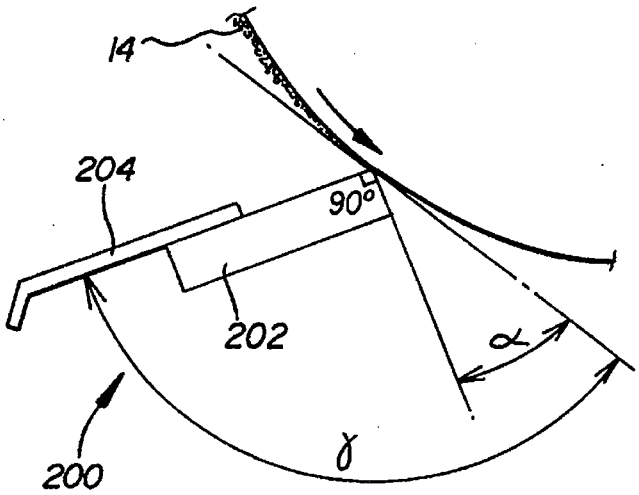
FIG. 5 is side elevational view, in cross-section and on an enlarged scale, of a portion of the toning roller and alternate cleaning mechanism, according to this invention, particularly showing the angular relationship therebetween.

As noted above, particulate matter from the developer material tends to be deposited on the shell 22 of the toning roller 14 of the magnetic brush development station 10. The cleaning mechanism, according to this invention, is provided to substantially remove the deposited particulate matter so as to assure optimum development efficiency. The embodiments of the cleaning mechanism, designated by the numeral 100 in FIGS. 1–3 and numeral 200 in FIGS. 4 and 5, include a polyurethane blade mounted such that the lead edge thereof contacts the shell 22 of the magnetic brush toning roller 14 at an angle $\alpha$ in the range of 10°–30°. The angle $\alpha$ is measured between the polyurethane blade and a plane tangent to the shell of the toning roller 14, through the line of contact of the lead edge of the blade and the toning roller, adjacent to the cleaned side of the toning roller.

Figure 2:
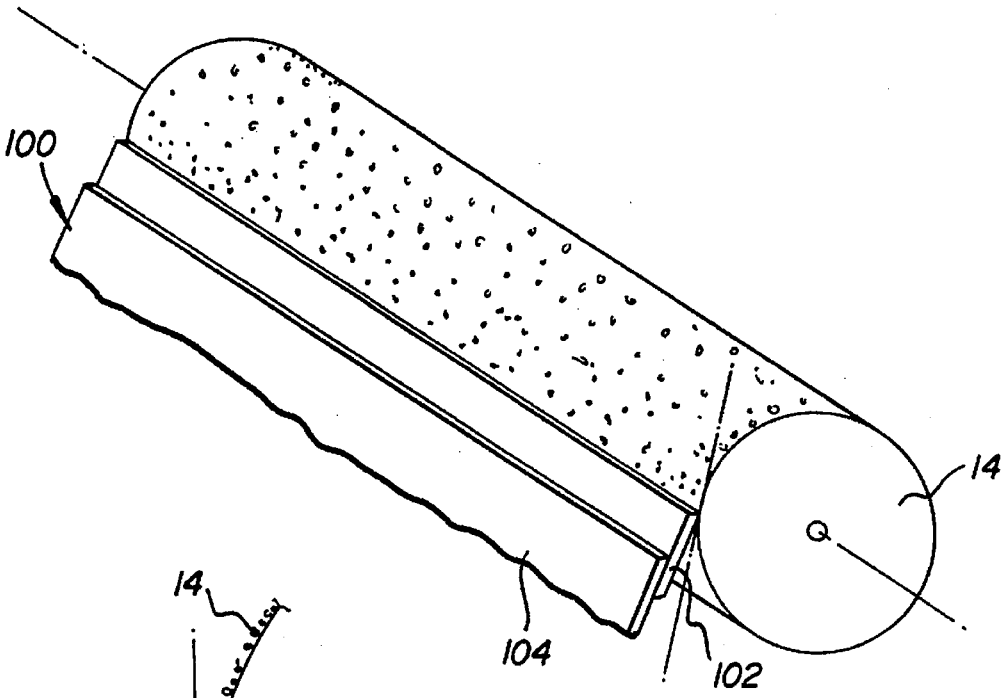
FIG. 2 is view, in perspective, of a the toning roller and cleaning mechanism, according to this invention, with portions removed or broken away to facilitate viewing.
Figure 3:
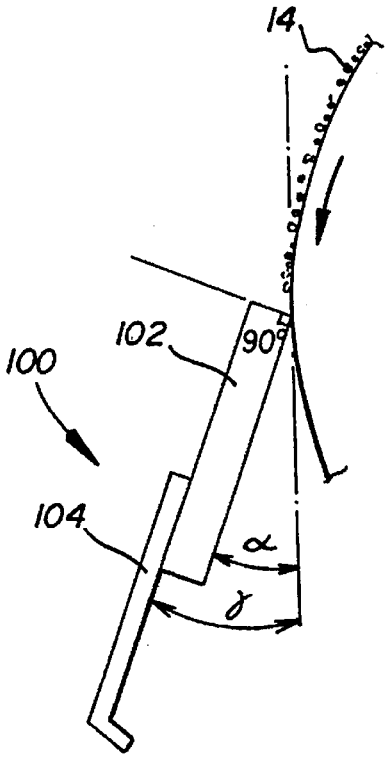
FIG. 3 is side elevational view, in cross-section and on an enlarged scale, of a portion of the toning roller and cleaning mechanism, according to this invention, particularly showing the angular relationship therebetween.

In the preferred embodiment as shown in FIGS. 1–3, the cleaning mechanism 100 includes a blade 102 mounted by a holder 104, attached to the interior wall of the portion 12*b* of the housing 12 of the development station 10, with the lead edge of the blade in contact with the toning roller 14. The holder 104 is formed of a non-magnetic material, such as non-magnetic stainless steel for example. It is important to the function of the cleaning mechanism 100 that the holder (and blade) be non-magnetic. As described above, the toning roller 14 includes a plurality of magnets producing a desired magnetic field, and the developer material D contains magnetic carrier particles moving in the magnetic field to cause marking particles to develop a latent image. The magnetic field of the toning roller could adversely effect the cleaning mechanism 100 if the holder 104 was to be formed of a magnetic material by inducing undesirable vibrations and/or induction heating therein. Moreover, if the holder 104 was to be formed of a magnetic material, the magnetic carrier particles would be attracted to the holder, plating out thereon, and not returning to the developer material reservoir portion 12*a* of the development station housing 12.

The blade 102 is mounted with the holder 104 in such a manner as to prevent the formation of wariness in the blade (such as might be caused by high relative humidity and temperature within the development station 10). The blade is, for example, glued to a non-magnetic stainless steel plate to maintain proper straightness. The mounting of the blade 102 for location relative to the toning roller 14 is such that the blade can be considered to be a cantilevered beam; i.e., fixed at the end attached to the plate of the holder 104, with a predetermined compliance provided by the selected polyurethane slab. Of course, other mounting techniques, such as spring loading the blade against the toning roller or articulating the blade, are also suitable for use with this invention.

The holder 104 is set at an angle $\gamma$, measured between the polyurethane blade and a plane tangent to the shell of the toning roller 14, through the line of contact of the blade and the toning roller, adjacent to the cleaned side of the toning roller. In this embodiment, the angle $\gamma$ is in the range of less than 45° so as to locate the lead edge of the blade 102 relative to the shell 22 of the toning roller 14 at the angle $\alpha$ in a manner for scrapping the toning roller surface. Further, the line of contact of the blade 102 to the toning roller 14 is located at a position about the circumference of the toning roller so that the holder 104 provides an attack angle for the blade which enables gravitational forces to aid in the transport of particulate matter cleaned from the surface of the toning roller back into the reservoir portion 12*a* of the development station housing 12.

The cleaning blade 102 is preferably a slab of polyurethane having a thickness of 0.100 cm to 0.200 cm, and with free extension between 0.500 cm and 1.000 cm from the holder 104. A deflection of 0.050 cm to 0.125 cm has been determined to be sufficient to provide for proper engagement of the blade with the toning roller 14 to effect the desired cleaning action. The polyurethane for the blade 102 is selected to have high resiliency (i.e., usually above 35% rebound), and a hardness within the range of approximately 50 to 85 Shore A. Moreover, the polyurethane is selected to exhibit low compression set, high resistance to abrasion and tear, and high resistance to ozone.

In the embodiment of FIGS. 1–3, the preferred parameters for the cleaning mechanism 100 are a polyurethane blade having a hardness of 70–80 Shore A, a thickness of 0.125 cm, glued to a non-magnetic steel stiffener plate of 0.125 cm thickness, with a free extension of 0.500 cm from such plate. The blade is mounted by the holder at an angle $\alpha$ of approximately 15°, and the holder is mounted at an angle $\gamma$ of approximately 15°. By such arrangement, no agglomerates will be produced during the cleaning action, and there will be no increase in drive torque. This results in high reliability and cleaning efficiency for the cleaning mechanism 100 irrespective of the configuration of the development station toning roller 14.

An alternate embodiment for the cleaning mechanism according to this invention, designated by the numeral 200 (FIGS. 4 and 5) includes a blade 202 mounted by a holder 204, attached to the interior wall of the portion 12*b* of the housing 12 of the development station 10, with the lead edge of the blade in contact with the toning roller 14. For the same reasons as described above with reference to the blade holder 104, the blade holder 204 is formed of a non-magnetic material. The holder 204 is positioned with the angle $\gamma$ in the range of 100°–135°, and locates the lead edge of the blade 202 relative to the toning roller 14 such that the angle $\alpha$ is in the range of 10°–30°. As such, the lead edge of the blade 202 will, in effect, wipe the surface of the toning roller 14 to provide for the cleaning thereof. As with the embodiment described above, the line of contact is located at a position about the circumference of the toning roller 14 so that the holder 204 provides an attack angle for the blade which enables gravitational forces to aid in the transport of the particulate matter cleaned from the surface of the toning roller back into the reservoir portion 12*a* of the development station housing 12. The blade may also perform the function of a dust shield to block air borne toner particles from escaping the station.

The above described embodiments for the cleaning mechanism 100 and 200, according to this invention, have been shown to substantially prevent the formation of scumming on the surface of the toning roller of a magnetic brush development station (as well as the condition, referred to as plate-out, in which a thicker layer of marking particles attaches to the toning roller surface resulting in degradation in image quality). For each respective embodiment, the toning roller rotates in a direction against the lead edge of the blade at low speed which will result in extended life for the blade. Furthermore, it is possible that by removing the developer material from the roller surface and allowing it to fall back into the mixing compartment portion 12*a* of the development station housing 12, better mixing response maybe achieved with new replenished marking particles added to the developer material mix; that is, the marking particle concentration will reach a stable condition faster. Degradation in image quality due to some of the above problems may lead to replacement of the developer at an early age and hence the above solution may extend the developer material life and the overall reliability of the materials and development station hardware.

The invention has been described in detail with particular reference to preferred embodiments thereof, but it will be understood that variations and modifications can be effected within the spirit and scope of the invention as set forth in the claims.

What is claimed is:

1. In development station for a reproduction apparatus, said development station including a toning roller for applying marking particles to a latent image to develop such image, a mechanism for cleaning such toning roller, said cleaning mechanism comprising:

an elongated polyurethane blade having a lead edge; and means for mounting said blade such that the lead edge contacts said toning roller at an angle to a plane tangent to said toning roller, said angle when measured between said plane and said blade adjacent to a cleaned side of said toning roller being in a range of approximately 10°–30°.

2. The cleaning mechanism of claim 1 wherein said elongated polyurethane blade has physical characteristics of high resilience, low compression set, and high resistance to abrasion and tear.

3. The cleaning mechanism of claim 2 wherein said elongated polyurethane blade has further physical characteristic of hardness in a range of approximately 50–85 Shore A.

4. The cleaning mechanism of claim 3 wherein said elongated polyurethane blade has further physical characteristic of high resistance to ozone.

5. The cleaning mechanism of claim 2 wherein said tangent to said toning roller is located such that gravitational force acts to aid in the transport of marking particles cleaned from said toning roller by said elongated polyurethane blade.

6. The cleaning mechanism of claim 5 wherein said blade mounting means includes a holder for said blade, said blade holder being mounted at an angle to said plane tangent to said toning roller in a range of less than 45° in order to position said blade to scrape marking particles from said toning roller.

7. The cleaning mechanism of claim 6 wherein said blade holder is formed of a non-magnetic material.

8. The cleaning mechanism of claim 5 wherein said blade mounting means includes a holder for said blade, said blade holder being mounted at an angle to said plane tangent to said toning roller in a range of 100°–135° in order to position said blade to wipe marking particles from said toning roller.

9. The cleaning mechanism of claim 8 wherein said blade holder is formed of a non-magnetic material.

10. The cleaning mechanism of claim 1 wherein said elongated polyurethane blade is formed as a slab having a thickness of between approximately 0.1–0.2 cm, and a free extension from said mounting means of about approximately 0.5–1.0 cm.

* * * * *